US006198825B1

(12) United States Patent
Daryanani

(10) Patent No.: US 6,198,825 B1
(45) Date of Patent: Mar. 6, 2001

(54) WIRELESS SPEAKER CIRCUIT

(76) Inventor: Narian Daryanani, 20 Austin Avenue, Room 1302, Kowloon (HK)

( * ) Notice: Subject to any disclaimer, the term of this patent is extended or adjusted under 35 U.S.C. 154(b) by 0 days.

(21) Appl. No.: 08/838,089

(22) Filed: Apr. 15, 1997

Related U.S. Application Data

(60) Provisional application No. 60/015,428, filed on Apr. 15, 1996.

(51) Int. Cl.[7] ..... H04H 5/00
(52) U.S. Cl. ..... 381/3
(58) Field of Search ..... 381/1, 2, 3, 77, 381/79, 14, 6, 16, 311; 455/6.3, 72, 42, 205, 344; 348/729

(56) References Cited

U.S. PATENT DOCUMENTS

| | | | | |
|---|---|---|---|---|
| 4,388,496 | * | 6/1983 | Miyamoto | 381/3 |
| 4,847,903 | * | 7/1989 | Schotz | 381/3 |
| 4,899,388 | * | 2/1990 | Mlodzikowski et al. | 381/77 |
| 5,038,402 | * | 8/1991 | Robbins | 381/3 |

* cited by examiner

*Primary Examiner*—Vivian Chang
(74) *Attorney, Agent, or Firm*—Michael Best &Friedrich

(57) ABSTRACT

A 900 MHz wireless speaker system having a tuning system that is features a variable down conversion scheme provided by a phase lock loop system controlled by a microprocessor and an automatic frequency control circuit. The speaker system utilizes either a battery and/or AC power source and provides remote control of features on the speaker.

4 Claims, 19 Drawing Sheets

| | |
|---|---|
| FIG.1a | FIG.1b |
| FIG.1c | FIG.1d |

Fig. 2a

| ITE | QTY | REFERENCE | PART NAME |
|---|---|---|---|
| 1 | 1 | IC5 | 4069 |
| 2 | 1 | ANT1 | ANT, CONN |
| 3 | 1 | IC1 | BA1404 |
| 4 | 1 | BATT1 | BATTERY, 6V |
| 5 | 1 | IC4 | BU2419 |
| 6 | 2 | C23 C33 | C, 0. 001UF |
| 7 | 1 | C5 | C, 0. 0022UF |
| 8 | 2 | C10 C36 | C, 0. 02UF |
| 9 | 2 | C7 C35 | C, 0. 04UF |
| 10 | 3 | C11 C25 C37 | C, 0. 1UF |
| 11 | 1 | C26 | C, 0. 22UF |
| 12 | 1 | C3 | C, 10P |
| 13 | 2 | C21 - 22 | C, 15P |
| 14 | 1 | C17 | C, 300P |
| 15 | 2 | C15 C20 | C, 30P |
| 16 | 2 | C16 C19 | C, 470P |
| 17 | 2 | JK1 - 2 | DCJACK, RCA - JACK |
| 18 | 1 | JACK1 | DCJACK1, DC 6V |
| 19 | 11 | D6 - 16 | DIODE - 1N4148 |
| 20 | 3 | ZD1 - 3 | DIODE - ZENER, 3V3 |
| 21 | 2 | C43 - 44 | EC, 0. 22UF |
| 22 | 3 | C6 C34 C41 | EC, 100UF |
| 23 | 1 | C2 | EC, 10UF |
| 24 | 2 | C1 C12 | EC, 2U2 |
| 25 | 1 | C4 | EC, 4.7UF |
| 26 | 1 | C45 | EC, 47UF |
| 27 | 1 | VCO1 | KSV - VCO |
| 28 | 1 | LED1 | LED |
| 29 | 1 | IC3 | PMB2306 |
| 30 | 1 | IC2 | PMB2312 |
| 31 | 1 | R63 | R, 0 |
| 32 | 4 | R11 - 12 R41 R64 | R, 10 |
| 33 | 2 | R56 R59 | R, 100K |
| 34 | 3 | R25 - 26 R46 | R, 10K |
| 35 | 1 | R19 | R, 150 |
| 36 | 1 | R45 | R, 15K |
| 37 | 1 | R4 | R, 1K |
| 38 | 1 | R22 | R, 1K5 |
| 39 | 2 | R13 R57 | R, 1K8 |
| 40 | 1 | R60 | R, 220 |
| 41 | 1 | R49 | R, 220K |
| 42 | 6 | R15 R38 - 39 R44 R47 R50 | R, 22K |
| 43 | 1 | R17 | R, 330K |
| 44 | 3 | R7 - 8 R21 | R, 390 |
| 45 | 1 | R20 | R, 3K3 |
| 46 | 1 | R42 | R, 470 |
| 47 | 1 | R16 | R, 47K |

Fig. 2b

| | | | |
|---|---|---|---|
| 48 | 1 | R65 | R, 4K7 |
| 49 | 1 | R62 | R, 560 |
| 50 | 2 | R18 R37 | R, 56K |
| 51 | 3 | R52 - 54 | R, 680K |
| 52 | 2 | R48 R58 | R, 68K |
| 53 | 1 | R5 | R, 8.2K |
| 54 | 2 | SW2 - 3 | SW - 4P3T |
| 55 | 1 | TC1 | TC, 5 - 35P |
| 56 | 3 | Q1 - 2 Q5 | TIP3055, 1923 |
| 57 | 2 | Q3 - 4 | TRNPN - TO92 - BEC, 1815 |
| 58 | 1 | VR1 | VR, 50KB |
| 59 | 1 | XT2 | XTAL1, 10.240MHZ |
| 60 | 1 | XT1 | XTAL1, 38KHZ |
| 61 | 1 | XT3 | XTAL1, 455K |

| | |
|---|---|
| FIG.3a | FIG.3b |
| FIG.3c | FIG.3d |

Fig. 4a

| ITE | QTY | REFERENCE | PART NAME |
|---|---|---|---|
| 1 | 1 | ANT1 | ANT |
| 2 | 1 | C18 | C, .22U |
| 3 | 1 | C15 | C, 0.02U/C |
| 4 | 1 | C12 | C, 100P/C |
| 5 | 5 | C3 C8 C26 C28 C37 | C, 103/C |
| 6 | 1 | C30 | C, 104/C |
| 7 | 1 | C35 | C, 10P/C |
| 8 | 3 | C9 - 11 | C, 15P/C |
| 9 | 2 | C27 C29 | C, 1P |
| 10 | 2 | C4 C32 | C, 22P/C |
| 11 | 1 | C5 | C, 25P/C |
| 12 | 1 | C36 | C, 270P |
| 13 | 1 | C31 | C, 300P/C |
| 14 | 2 | C16 - 17 | C, 30P/C |
| 15 | 1 | C14 | C, 330P/C |
| 16 | 1 | C13 | C, 390P/C |
| 17 | 1 | C19 | C, 403/C |
| 18 | 1 | C7 | C, 4P |
| 19 | 1 | C33 | C, 5P/C |
| 20 | 1 | C34 | C, WIRE |
| 21 | 1 | C38 | E, 100U |
| 22 | 1 | C2 | E, 10U |
| 23 | 2 | C22 - 23 | E, 1U |
| 24 | 1 | C1 | E, 220U |
| 25 | 1 | C25 | E, 33UF |
| 26 | 1 | C6 | E, 3U3 |
| 27 | 1 | C20 | E, 47U |
| 28 | 2 | C21 C24 | E, 4U7 |
| 29 | 1 | L1 | COIL, 0.68MH |
| 30 | 1 | IC3 | CXA1283 |
| 31 | 4 | D1 - 4 | DIODE, 1N4148 |
| 32 | 3 | IFT1 2 3 | IFT - H |
| 33 | 1 | VCO1 | KSV - VCO, 914 |
| 34 | 1 | LED101 | LED/2COLOR |
| 35 | 1 | IC1 | PMB2306 |
| 36 | 1 | IC2 | PMB2312 |
| 37 | 1 | R100 | R, 100K |
| 38 | 2 | R16 R21 | R, 10K |
| 39 | 3 | R2 R18 R25 | R, 120 |
| 40 | 1 | R19 | R, 150 |
| 41 | 1 | R7 | R, 1K5 |
| 42 | 2 | R13 R22 | R, 220K |
| 43 | 2 | R10 R12 | R, 22K |
| 44 | 1 | R17 | R, 270 |
| 45 | 1 | R11 | R, 27K |
| 46 | 5 | R6 R15 R26 - 28 | R, 2K2 |
| 47 | 1 | R5 | R, 330 |

Fig. 4b

| | | | |
|---|---|---|---|
| 48 | 1 | R8 | R, 330K |
| 49 | 1 | R3 | R, 33K |
| 50 | 1 | R4 | R, 390 |
| 51 | 1 | R9 | R, 3K3 |
| 52 | 3 | R14 R23 R30 | R, 4K7 |
| 53 | 1 | R20 | R, 68K |
| 54 | 1 | R1 | R1/8W, 120 |
| 55 | 2 | R101 R103 | RES, 270 |
| 56 | 3 | R102 R104 - 105 | RES, 68K |
| 57 | 1 | CON1 | SIP8 |
| 58 | 1 | CON2 | SIP/3 |
| 59 | 2 | TC1 - 2 | TC, 5 - 35P |
| 60 | 1 | Q1 | 1923 |
| 61 | 1 | Q2 | 914 |
| 62 | 2 | Q101 - 102 | 9013 |
| 63 | 1 | VR2 | VR, 1K |
| 64 | 1 | VR1 | VR, 500 |
| 65 | 1 | FLT2 | X455KC |
| 66 | 1 | FLT1 | XTAL, 10. 7KHZ |
| 67 | 1 | XL1 | XTAL1, 10.240MHZ |

| | |
|---|---|
| FIG.5a | FIG.5b |
| FIG.5c | FIG.5d |

Fig. 6a

BILL OF MATERIALS FOR FLEXADO3 . SCH ON WED APR 10 15:17:04 1996

| ITE | QTY | REFERENCE | PART NAME |
|---|---|---|---|
| 1 | 1 | U5 | 4017 |
| 2 | 1 | U4 | 4069 |
| 3 | 2 | D110 - 111 | 1N4001, 1N4001 |
| 4 | 2 | D108 - 109 | 1N4148, 2A |
| 5 | 1 | J4 | 1PIN, B |
| 6 | 1 | J5 | 1PIN, G |
| 7 | 1 | J8 | 1PIN, G1 |
| 8 | 1 | J6 | 1PIN, L |
| 9 | 1 | J2 | 1PIN, O |
| 10 | 2 | J3 J7 | 1PIN, R |
| 11 | 1 | J1 | 1PIN, Y |
| 12 | 1 | J9 | 1PIN, Y1 |
| 13 | 2 | BATT1 - 2 | BATT |
| 14 | 1 | BATT3 | BATT, 12V BATT |
| 15 | 1 | U2 | BU2458 |
| 16 | 1 | C20 | CAP1, 0.022UF(M) |
| 17 | 3 | C13 C18 - 19 | CAP1, 0.1UF |
| 18 | 1 | C101 | CAP1, 3U3 (M) |
| 19 | 1 | C39 | CAP+, 100UF |
| 20 | 1 | C47 | CAP+, 47UF |
| 21 | 1 | C65 | CAPE\RAD\2\5, 0.1UF |
| 22 | 3 | C16 C49 - 50 | CAPE\RAD\2\5, 1000UF/16V |
| 23 | 1 | C71 | CAPE\RAD\2\5, 100UF |
| 24 | 2 | C66 C73 | CAPE\RAD\2\5, 10UF |
| 25 | 1 | C74 | CAPE\RADV2\5, 1U |
| 26 | 4 | C11 C14 C17 C67 | CAPE\RAD\2\5, 220UF |
| 27 | 3 | C25 C43 C72 | CAPE\RAD\2\5, 22UF |
| 28 | 5 | C1 C15 C23 C27 C61 | CAPE\RAD\2\5, 2U2 |
| 29 | 2 | C7 C70 | CAPE\RAD\2\5, 47UF |
| 30 | 1 | C76 | CAPE\RAD\2\5, 4U7 |
| 31 | 1 | C56 | CAP\CR08, 0.001UF |
| 32 | 1 | C59 | CAP\CR08, 0.0033UF(M) |
| 33 | 2 | C55 C60 | CAP\CR08, 0.005UF |
| 34 | 2 | C62 - 63 | CAP\CR08, 0.01(M) |
| 35 | 1 | C54 | CAP\CR08, 0.015UF |
| 36 | 1 | C68 | CAP\CR08, 0.01UF |
| 37 | 1 | C64 | CAP\CR08, 0.022(M) |
| 38 | 1 | C48 | CAP\CR08, 0.068UF |
| 39 | 1 | C21 | CAP\CR08, 102 |
| 40 | 3 | C2 - 3 C6 | CAP\CR08, 102(M) |
| 41 | 1 | C4 | CAP\CR08, 203 |
| 42 | 1 | C75 | CAP\CR08, 500P |
| 43 | 1 | C5 | CAP\CR08, 682(M) |
| 44 | 2 | L1 - 2 | COIL, 4.7MH |
| 45 | 2 | JACK1 - 2 | DCJACK1 |

Fig. 6b

| | | | |
|---|---|---|---|
| 46 | 11 | D5 D8 - 17 | DIODE, 1N4148 |
| 47 | 1 | ZD1 | DIODE - ZENER, 5V1 |
| 48 | 1 | LED1 | LED |
| 49 | 1 | U6 | LM324 |
| 50 | 2 | R23 R26 | RES, 1 |
| 51 | 2 | R16 R88 | RES, 10 |
| 52 | 2 | R47 R55 | RES, 100 |
| 53 | 7 | R12 R66 - 68 R70 R74 R80 | RES, 100K |
| 54 | 4 | R10 - 11 R62 R64 | RES, 10K |
| 55 | 2 | R72 - 73 | RES, 12K |
| 56 | 2 | R59 - 60 | RES, 150K |
| 57 | 2 | R77 R85 | RES, 15K |
| 58 | 2 | R69 R76 | RES, 180K |
| 59 | 1 | R50 | RES, 18K |
| 60 | 1 | R15 | RES, 1K |
| 61 | 2 | R29 R61 | RES, 1K2 |
| 62 | 5 | R22 R52 - 53 R58 R78 | RES, 1K8 |
| 63 | 3 | R2 R4 R25 | RES, 22 |
| 64 | 1 | R51 | RES, 22 1W |
| 65 | 6 | R1 R7 R36 R45 - 46 R87 | RES, 22K |
| 66 | 1 | R27 | RES, 270K |
| 67 | 1 | R71 | RES, 27K |
| 68 | 1 | R79 | RES, 2K2 |
| 69 | 2 | R18 - 19 | RES, 2M2 |
| 70 | 1 | R24 | RES, 33 |
| 71 | 2 | R33 R84 | RES, 330 |
| 72 | 2 | R31 - 32 | RES, 39 |
| 73 | 1 | R75 | RES, 390K |
| 74 | 2 | R3 R82 | RES, 4K7 |
| 75 | 2 | R8 - 9 | RES, 56K |
| 76 | 3 | R5 - 6 R17 | RES, 5K6 |
| 77 | 1 | R21 | RES, 680 |
| 78 | 1 | R65 | RES, 680K |
| 79 | 1 | R81 | RES, 820K |
| 80 | 2 | SPK1 - 2 | SPK |
| 81 | 2 | SW4 SW11 | SW - 094 |
| 82 | 1 | SW1 | SW - SPDT, |
| 83 | 1 | SW2 | SW1P3T |
| 84 | 2 | SW5 SW12 | SWH - 012 |
| 85 | 1 | U3 | TDA2007 |
| 86 | 4 | Q1 - 3 Q7 | TRNPN - TO92 - CBE, 1815BL |
| 87 | 1 | Q4 | TRNPN - TO92 - CBE, 8050 |
| 88 | 1 | Q6 | TRNPN - TO92 - CBE, 9014 |
| 89 | 2 | Q5 Q8 | TRPNP - TO92 - EBC, 9015 |
| 90 | 1 | VR3 | VR, 250KB |
| 91 | 3 | VR1 - 2 VR11 | VRES |
| 92 | 1 | XT1 | XTAL, 2MHZ |

WIRELESS SPEAKER CIRCUIT

This application claims priority to U.S. Provisional Application Ser. No. 60/015,428, filed Apr. 15, 1996.

BACKGROUND OF THE INVENTION

This invention generally relates to wireless speaker systems; and, more particularly, it relates to a 900 MHz Wireless Speaker System.

Traditional wireless speaker systems have problems associated with tuning systems that cause drift, and are not truly wireless in that they use hardwired AC power sources to drive speakers in the system. Further, prior art speaker systems have the drawback of using fixed frequency downconverters. Hence, there exists a need for a wireless speaker system that eliminates or reduces the problems in the prior art speaker systems and does not utilize fixed frequency downconverters. Exemplary speaker systems having the drawbacks described above are illustrated in the U.S. Pat. Nos. 5,272,525 and 5,410,735. It is an object of the present invention to solve the problems in the art.

SUMMARY OF THE INVENTION

The present invention provides a 900 MHz wireless speaker system that uses a phase lock loop system in conjunction with a microprocessor to perform a variable fequency down conversion scheme that locks onto the carrier frequency eliminating problems associated with drift of the carrier frequency. The present invention include a phase lock loop control circuitry, local oscillation frequency of the variable frequency downconverter, and downconversion beat frequency that is not fixed (but variable). Tuning of the present invention is accomplished in the variable setting on the phase lock loop system by a variable downconversion beat frequency. The design has the advantage of not requiring any tuning system on another circuit area.

The wireless speaker system of the present invention further utilizes a battery power source and/or alternating current power source, and provides for a remote control to control the various features on the speaker. Other features of the invention include a wireless transmitter, an antenna, and a wireless frequency modulated receiver.

The objects and features of the present invention, other than those specifically set forth above, will become apparent in the detailed description of the invention set forth below.

BRIEF DESCRIPTION OF THE DRAWINGS

FIGS. 2*a* and 2*b* is a parts list for the schematic of FIG. 1;

FIGS. 4*a* and 4*b* are a parts list for the schematic of FIGS. 1*a* through 1*d*;

FIG. 6 is a parts list for the schematic of FIG. 3;

DETAILED DESCRIPTION OF THE INVENTION

Figures 1, 1A:
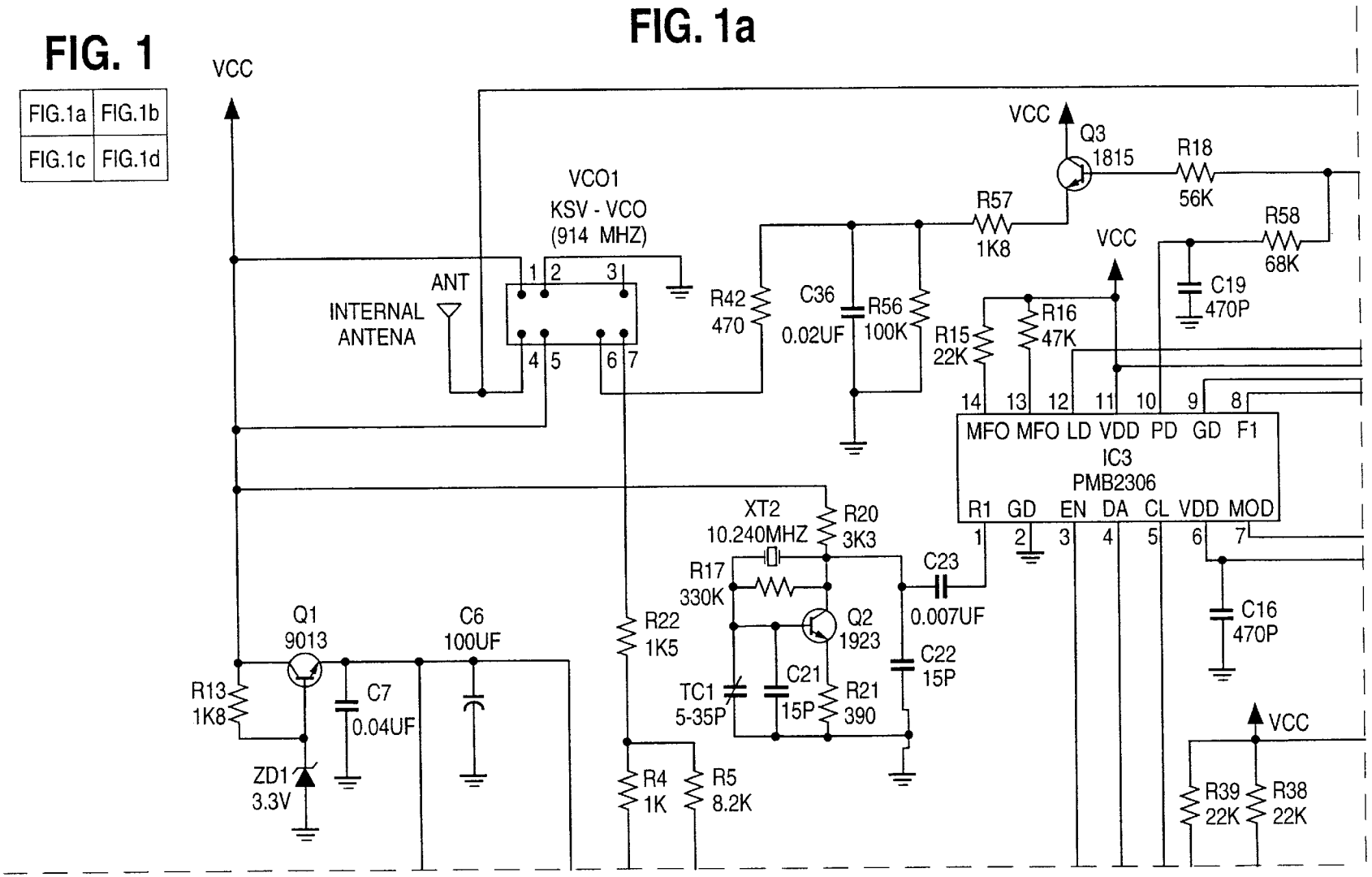
FIGS. 1*a* through 1*d* are block diagrams of components of the present invention.
Figure 1B:
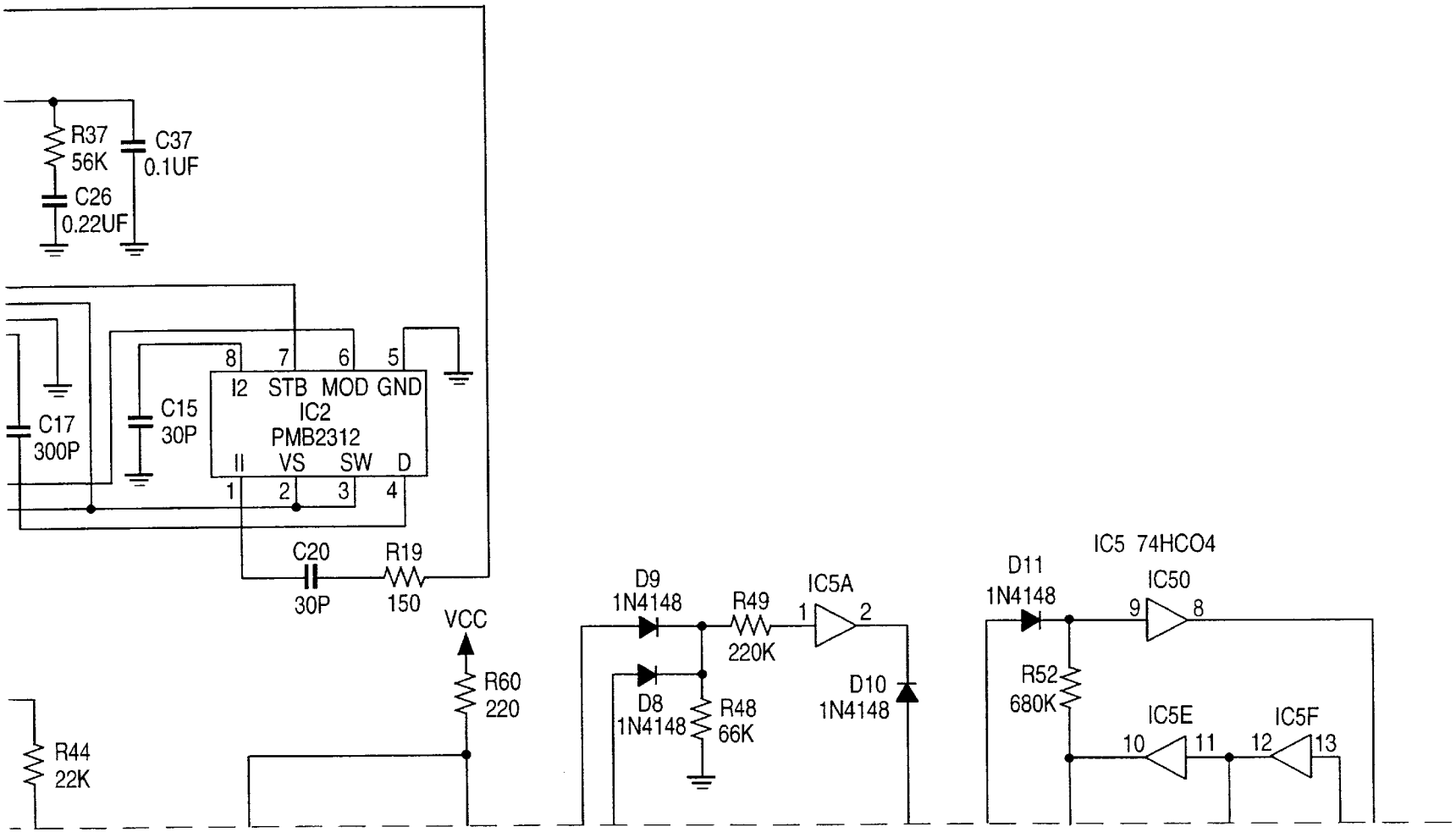
Figure 1C:
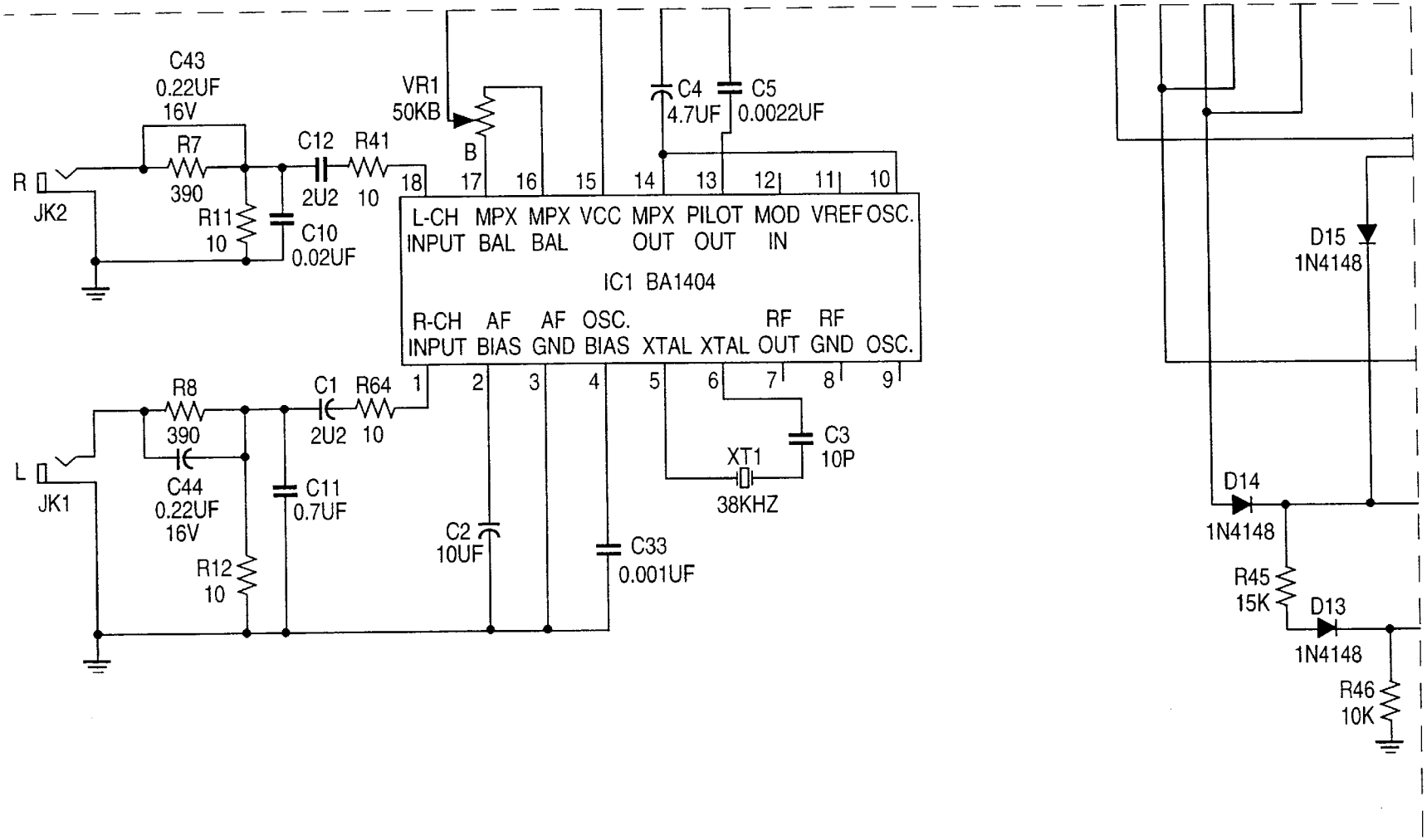
Figure 1D:
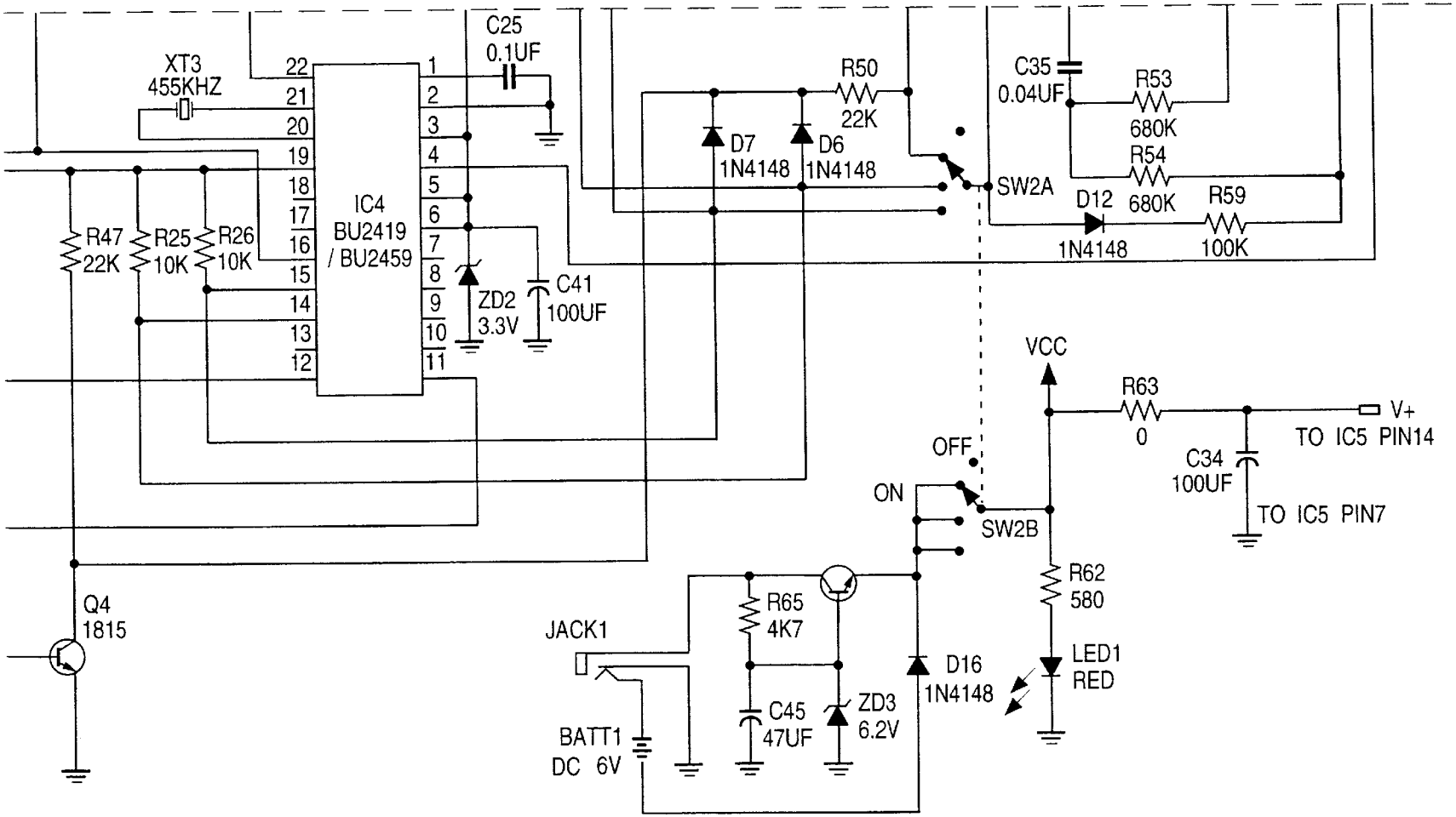

FIG. 1 illustrates a circuit approach used in the present invention. The variable frequency oscillator in the present invention includes a microprocessor, a variable control oscillator, pre-scaler, phase detector, low pass filter, and a mixer. This circuit uses, one microprocessor, one phase locked loop IC, one pre-scaler IC, two crystals, one VC module, a few transistors and a pair of speakers. FIGS. 2*a* and 2*b* show in particularity a feedback loop from the Automatic Frequency Control.

FIG. 1 shows in particularity a feedback loop from the Automatic Frequency Control (AFC) to the PLL circuit in the initial IF stage variable frequency down conversion. It is found that the clock generator of the PLL can be fine adjusted up to 30 KHz by the AFC feedback signal, which can compensate a 240 KHz drift in the transmitter carrier frequency. The channel select coarsely tunes the variable frequency down conversion and the AFC feedback signal self adjusts the fine tuning of the variable frequency down conversion.

Variable down conversion is a novel feature of the current invention. Fixed frequency down conversion offsets the carrier frequency by a specified frequency, where tuning must be accomplished by a second stage. The current invention uses variable frequency down conversion which self adjusts offseting the received signal by a variable frequency, down converting to a specified frequency. Variable frequency down conversion on the first intermediate frequency ("IF") stage eliminates the need to tune the circuit in a subsequent stage. Tuning the circuit in the first IF stage increases the signal to noise ratio of the over all system because the signal strength of the received signal is maximized, thereby decreasing the neccessary gain of the system to acheive a given output. Tuning in the first IF stage also lowers the distortion and coloration of the audio signal by a subsequent stage that filters the audio signal from the intermediate frequency thereby providing improved signal quality and frequency response.

The speaker system of the present invention further includes a double conversion feature whereby signals are first downconverted to the first IF (intermediate frequency), and then to the 2nd IF, but on the second IF AFC (auto frequency control) is implemented by Phase Lock Loop that feeds a control signal back to the first IF stage thereby eliminating any significant drift and performs the tuning of the circuit.

A wireless speaker system utilizing a carrier frequency which may vary with time comprising: means for transmitting an audio signal modulated on said carrier frequency, means for receiving said audio signal modulated on said carrier frequency, means for variably down converting the carrier frequency to an intermediate frequency, means for separating said audio signal from said intermediate frequency; and, means for transducing the audio signal into accoustical energy (FIG. 9). Said means for variably down converting said carrier frequency is self adjusting to said carrier frequency.

Figures 3, 3A:
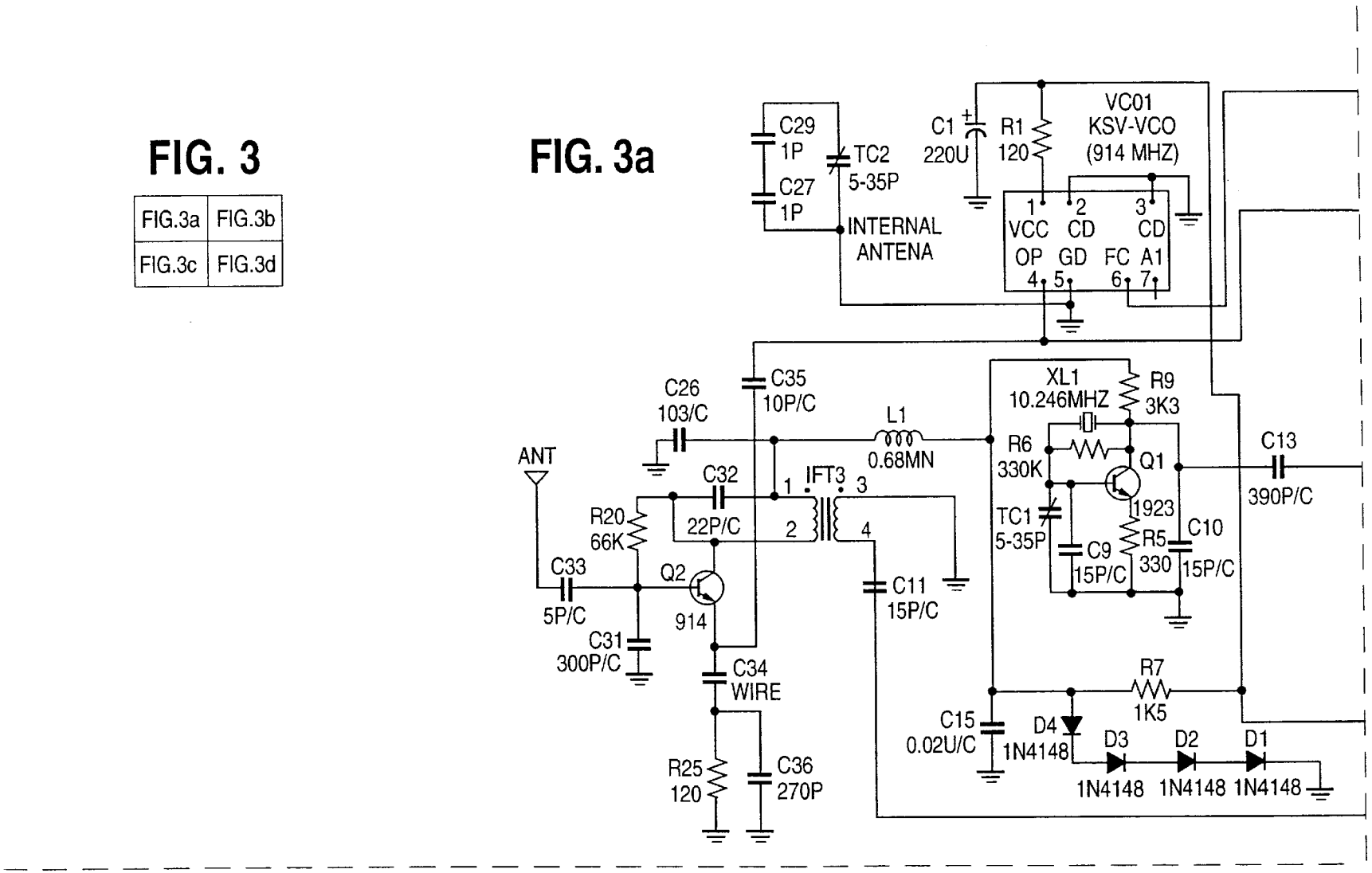
FIGS. 3*a* thru 3*d* are electrical schematics of a circuit for a stereo transmitter board of the present invention.
Figure 3B:
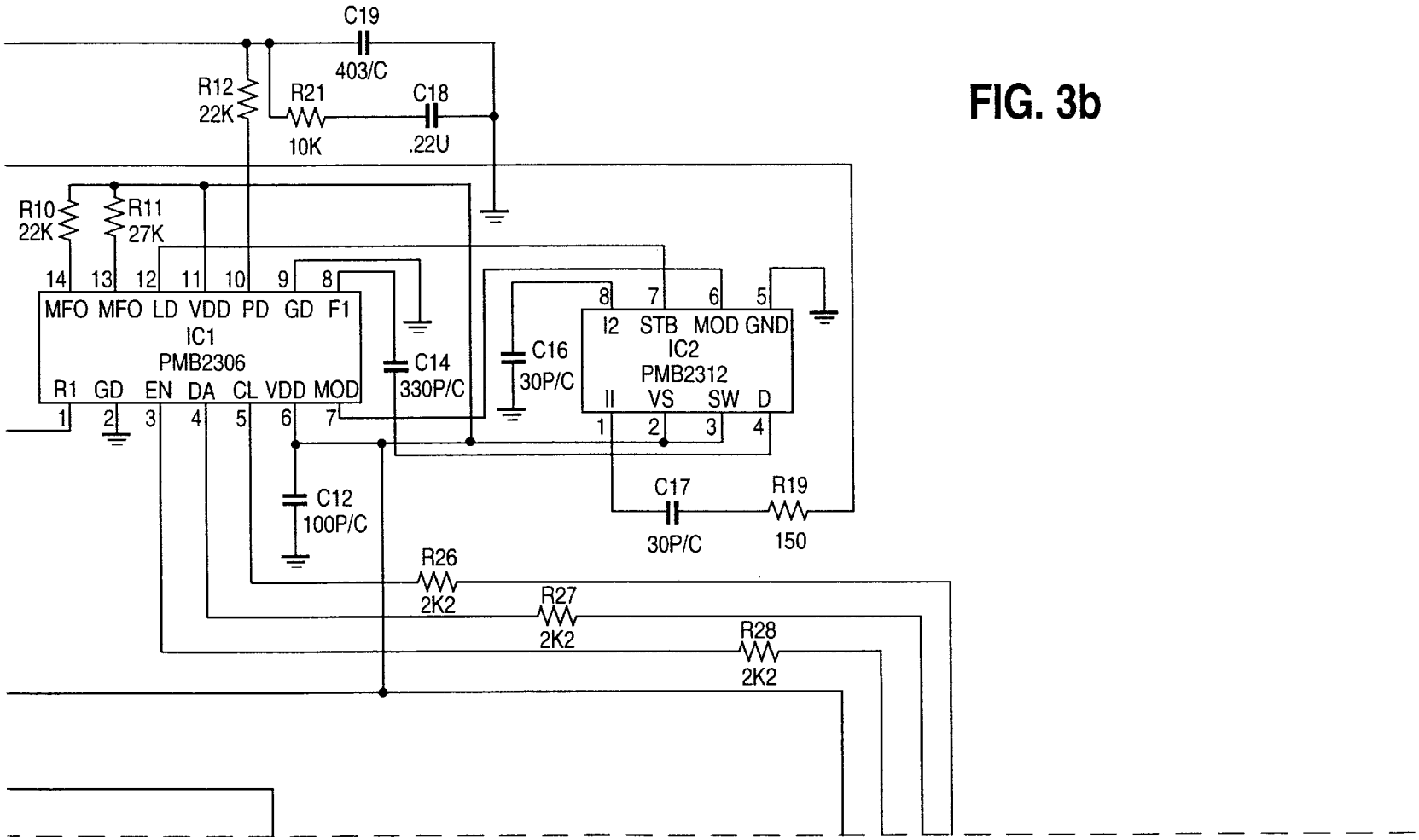
Figure 3C:
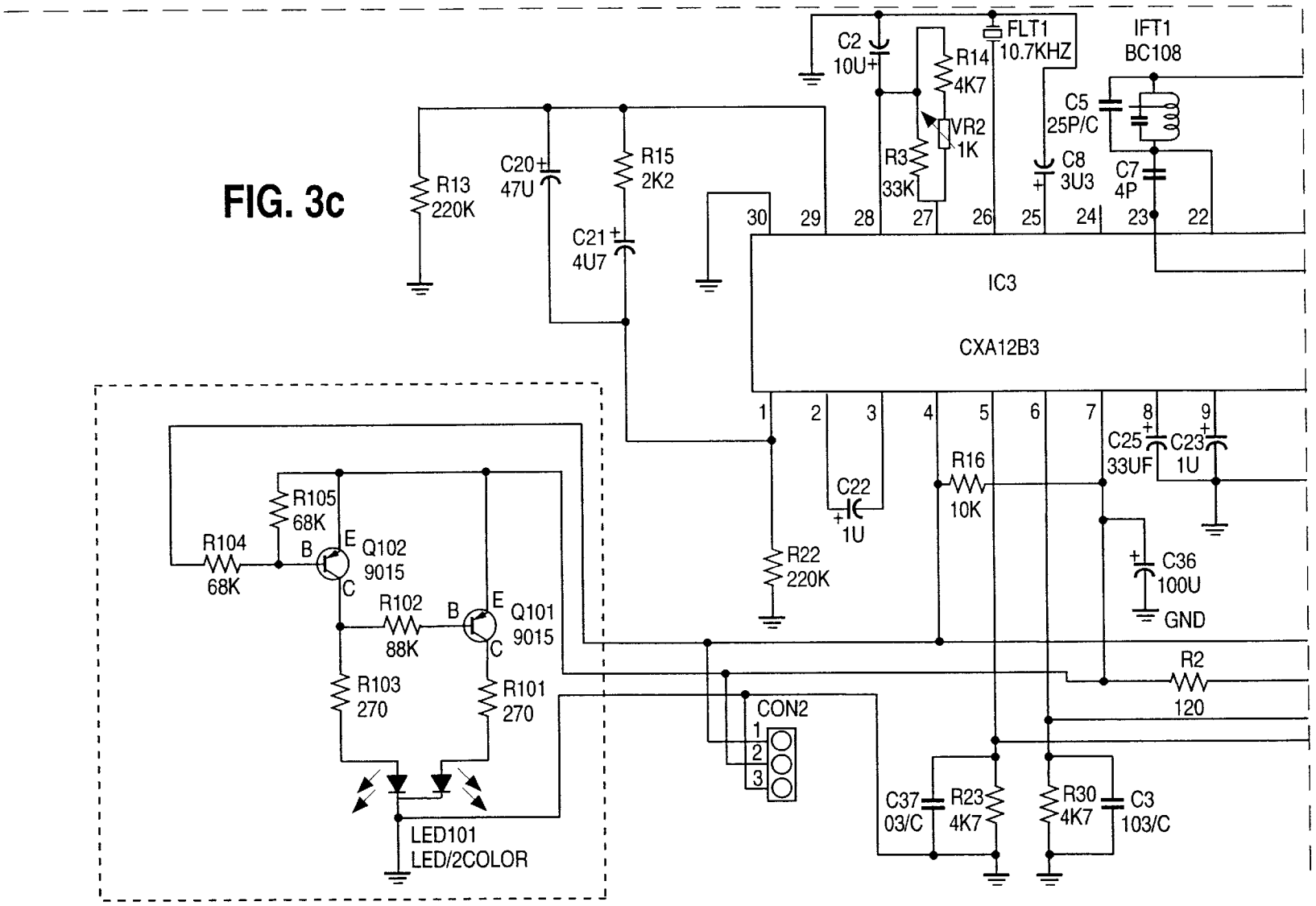
Figure 3D:
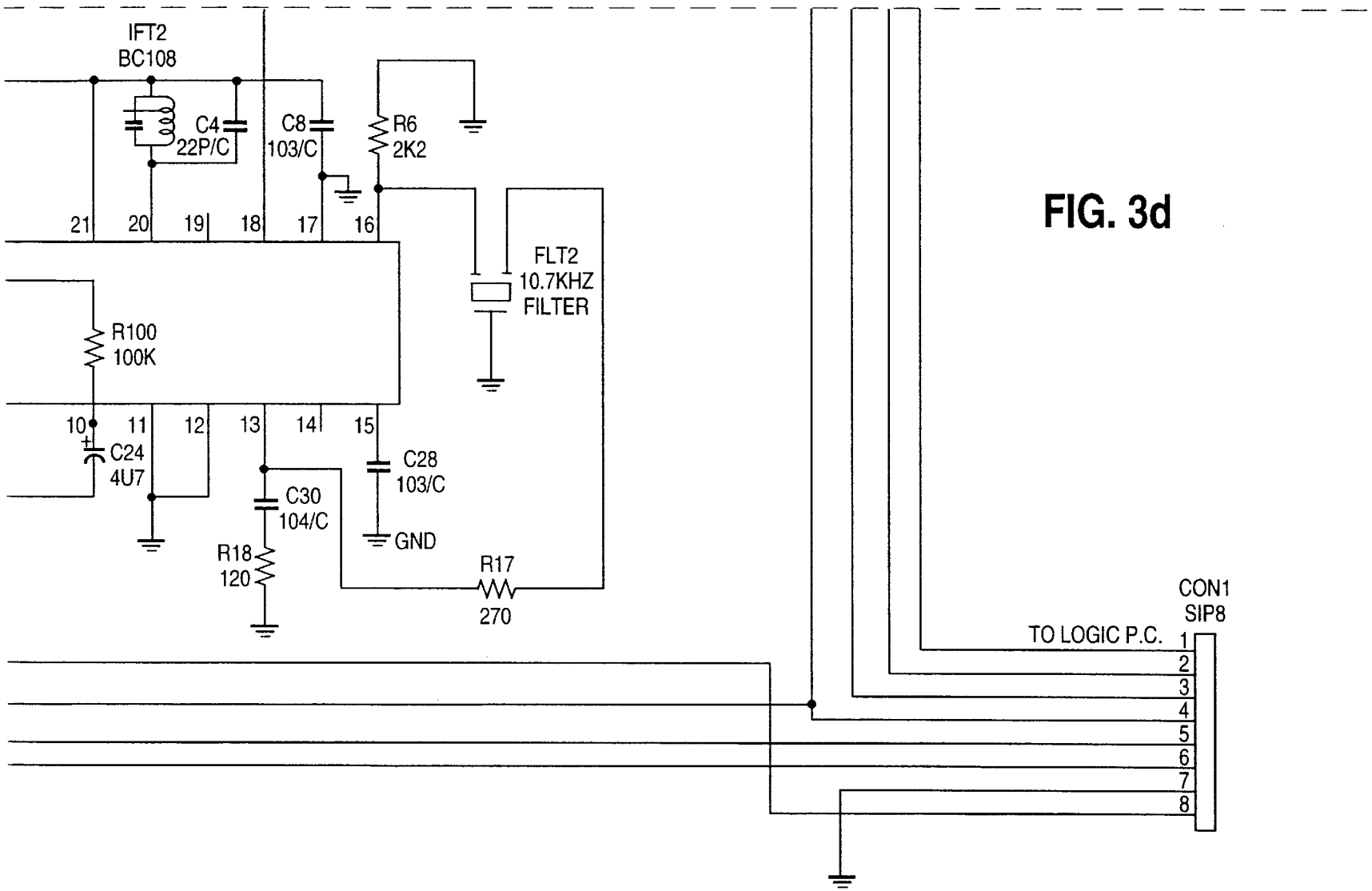
Figures 5, 5A:
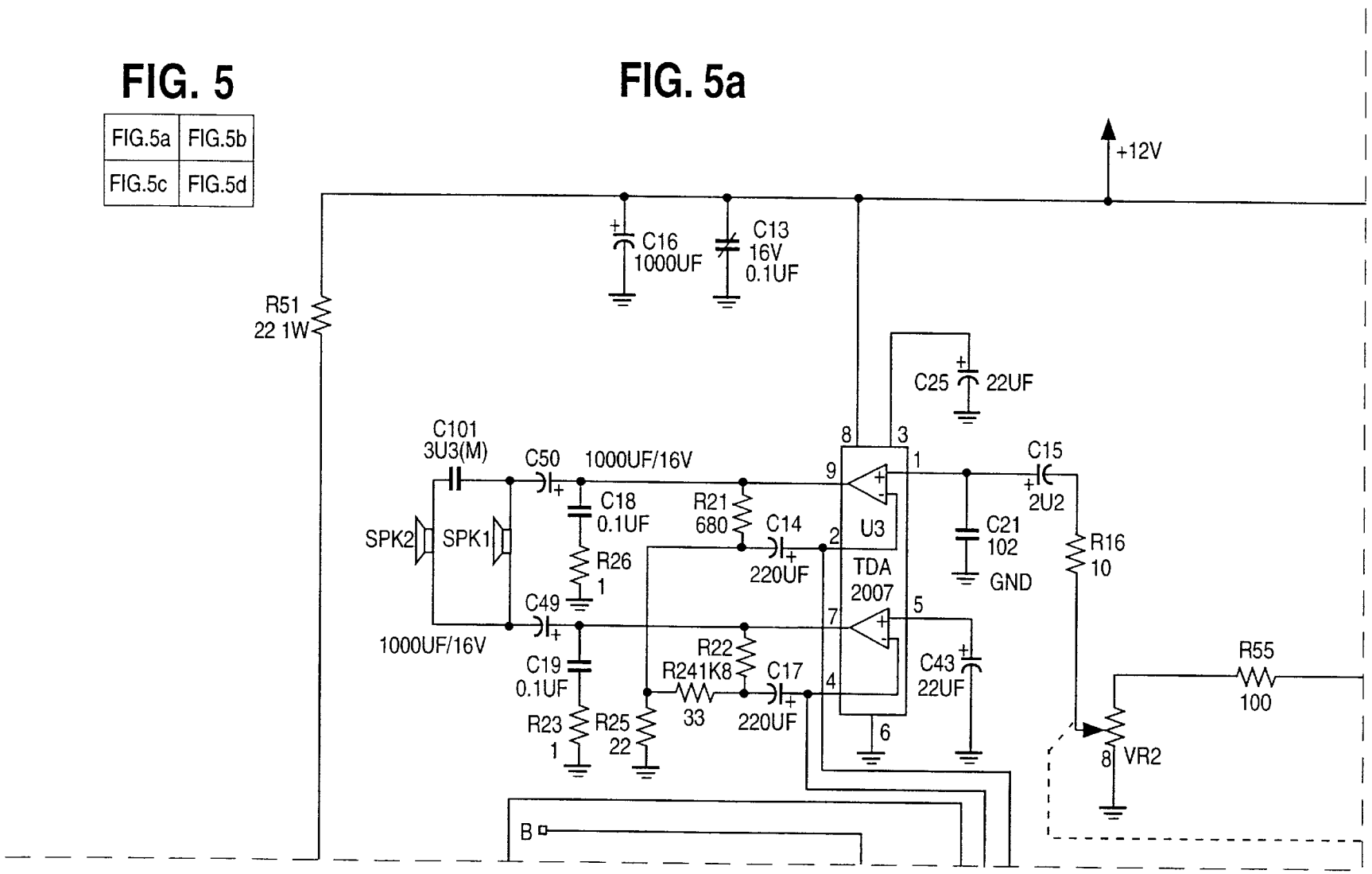
FIG. 5 is a 900 MHz speaker receiver board and circuit diagram of the present invention.
Figure 5B:
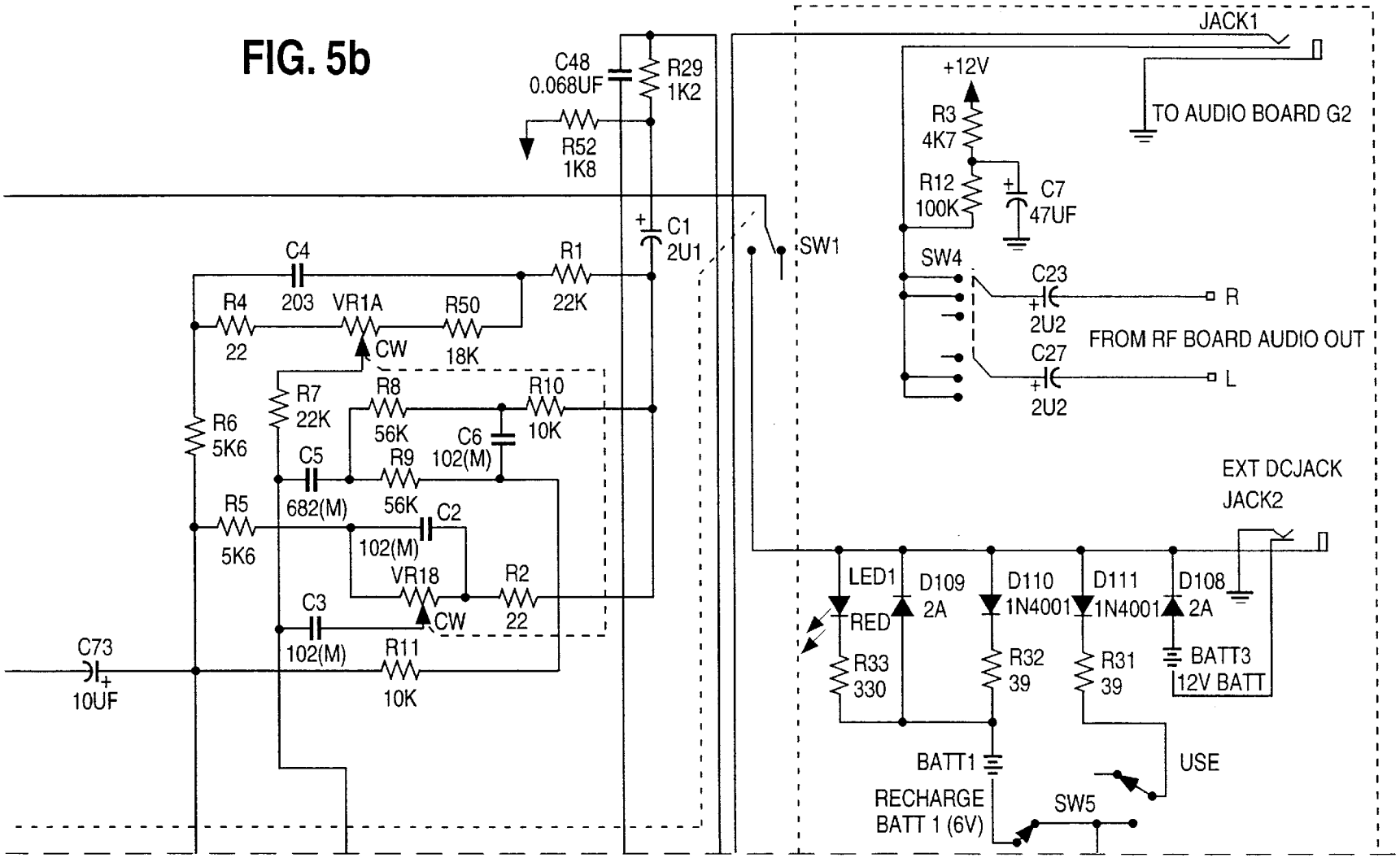
Figure 5C:
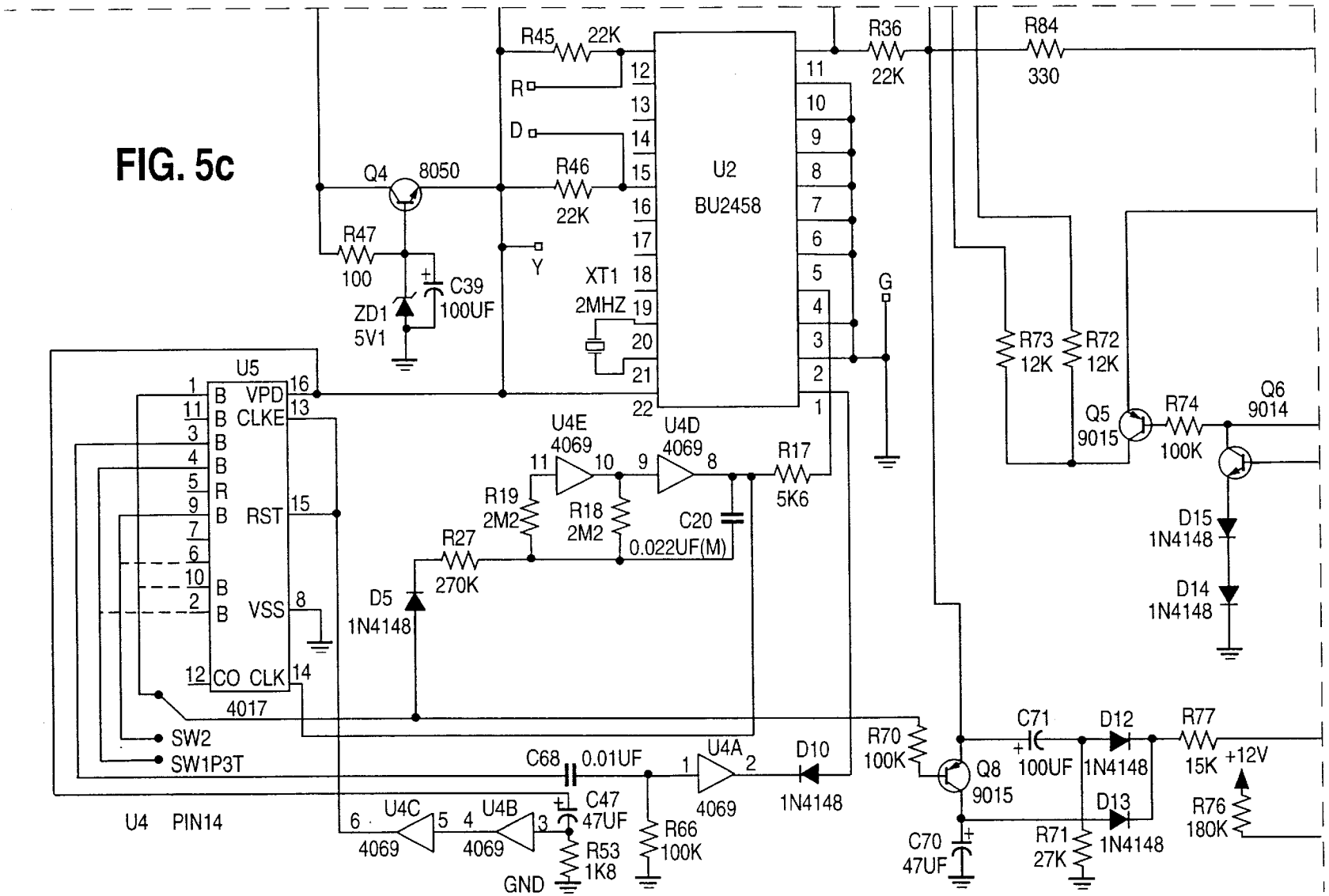
Figure 5D:
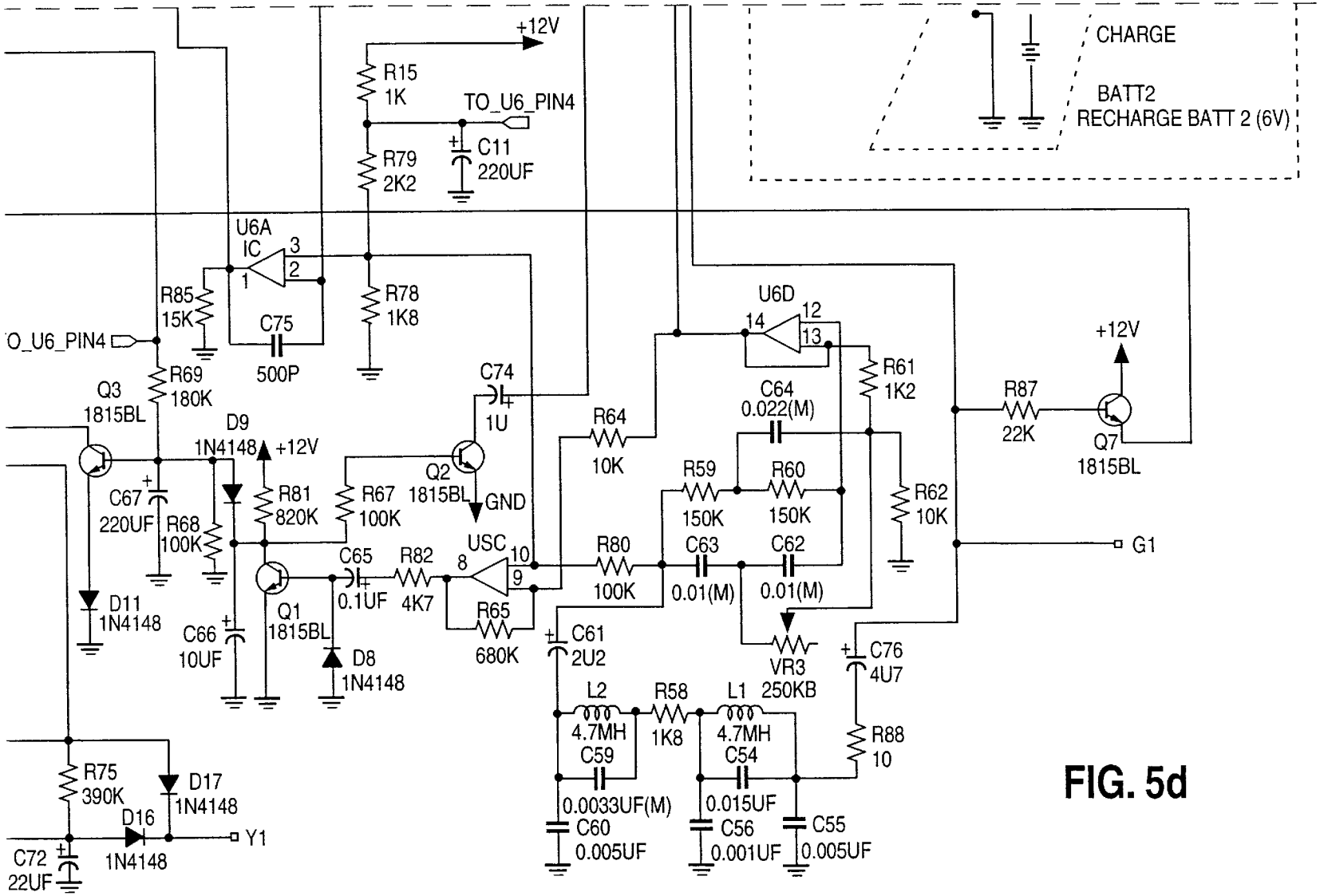

FIG. 3 illustrates the 900 MHz stereo transmitter board. The accompanying bill of materials or parts list in FIG. 2 lists and references all of the parts that comprise the 900 MHz stereo transmitter board of FIG. 1. All components are to be at least suitable for use in the commercial temperature range. Item 1 comprises a high band width quad-buffer. Suitable equivalents are well known in the art. Item 2 is an antenna connector that is suitable for use with a 900 MHz signal. Many equivalent connectors are known in the art. Item 3 is a modulator used to combine the left and right audio signals. Item 4 is a 6 volt battery used to supply power to the 900 MHZ transmitter board. Item 5 is a BU2419, which tracks the carrier signal, is well know by those skilled in the art. Item 6 through Item 15 comprise capacitors. Item 17 is an RCA jack, several equivalents such as ¼th inch or ⅛th inch jacks may be used for example. Item 18 is a standard D.C. jack suitable for use with a 12 volt D.C. supply. Item 19 is a diode, many equivalents are well known in the art. Item 20 is a Zener diode having a threshold voltage of 3.3 volts. Item 21 through Item 26 comprise electrolytic capacitors of standard commercial tolerance. Item 27 is a voltage controlled oscillator, functioning to up modulate the signal for transmitting at approximately 914 MHz. Item 28 is a light emitting diode of any color. Item 29 is a PMB2306, a component well known in the art, supplying the carrier frequency to Item 27. Item 30 is a PMB2312 that controls Item 29 supplying the carrier frequency. Item 31 through Item 53 comprise resistors of standard commercial tolerance, equivalents are well known in the art. Item 54 are four-pole-double-throw switches rated for use with 12 volts D.C. Item 55 is a variable resistor of 50 Kilo-ohms and of standard commercial tolerance. Item 59 through Item 61 comprise crystal oscillators, non-crystal equivalents are well known in the art for use as a clock signal.

As illustrated in FIG. 1, IC 1 BA1404, IC 2 PMB 2312, IC 3 PMB 2306, IC 4 BU 2419/BU 2459, are commercially available. A description of BA 1404 and other ICs ("integrated circuits") can be found in the *Master IC Cookbook* published by Tab Books Blue Ridge Summit, Pa. (1991). FIG. 3 illustrates a 900 MHz speaker receiver board, being the receiver circuit of the mhz modulated signal transmitted from the MHZ stereo transmitter board of FIG. 1. The bill of materials in FIG. 4 lists and references all of the parts that comprise the 900 MHz speaker receiver board of FIG. 3. All components are to be at least suitable for use in the commercial temperature range. Item 1 is an antenna suitable to receive a 900 MHz carrier signal with a bandwidth of at least the essential audio spectrum. Item 2 through Item 20 comprise capacitors of standard tolerance, the designation "/C" denotes ceramic capacitors, this is well known in the art. Item 21 through Item 28 comprise electrolytic capacitors of standard commercial tolerance. Item 29 is an tuning coil, comprising an inductor of 0.68 Milli-Henrys. Item 30 is a tuner to filter the modulated audio signal from the carrier signal. Item 31 comprises diodes, many equivalents are known to those skilled in the art. Item 32 comprises transformers. Item 33 comprises a voltage controlled oscillator capable of tracking a 914 MHz control signal. Item 34 is a two color light emitting diode, of any color combination, which is well known in the art. Item 35 and Item 36 function to track the carrier frequency. Item 37 through Item 56 are resistors of standard commercial tolerance. Item 57 is an 8 pin connector, of which many equivalent connectors are well known to those skilled in the art. Item 59 comprises variable capacitors used to tune the circuit for optimal reception. Item 60 through Item 63 comprise diodes. Item 63 and Item 64 are variable resistors of standard commercial tolerances. Item 65 and Item 66 are 10.7 kilohertz notch filters. Item 67 is a crystal oscillator, many non-crystal clocks are also available and are well known in the art. As illustrated in FIG. 3, IC 1 PMB 2306, and IC 2 PWB 2312, are commercially available.

Figure 7:
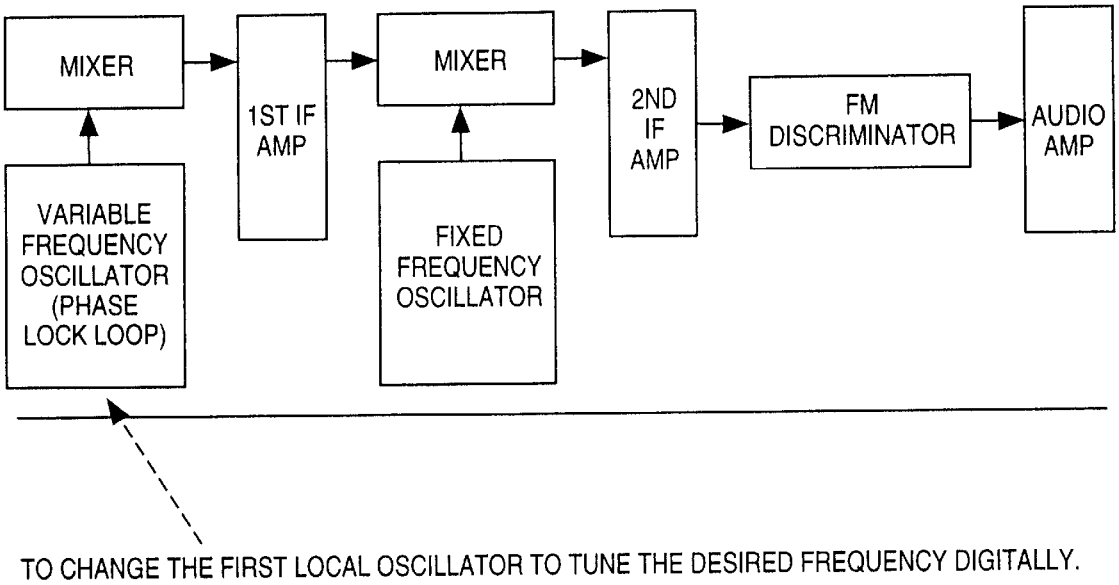
FIG. 7 is an audio board and control board of the present invention.

FIG. 7 illustrates the Audio Board and Control Board of the present invention. The bill of materials in FIG. 6 lists and references all of the parts that comprise the Audio Board and Control Board. All components are suitable for use in the commercial temperature range. Item 1 is a demultiplexer used in selecting a frequency range for the system to operate in performing the down conversion of a received signal. Item 2 is a buffer which may be implemented as four separate buffers or as a quad-pack minimizing layout area on the circuit board and also minimizing cost. Items 3 and 4 are diodes. Item 5 through Item 12 are connections to the 900 MHz speaker receiver board. Item 13 comprises two 6 volt batteries supplying power to the Audio Board and Control Board and the 900 MHz speaker receiver board. Item 14 is also a battery supplying power to the Audio Board and Control Board and the 900 MHz speaker receiver board. Item 15 is a BU2458 of which its function and equivalents are well known in the art. Item 16 through Item 43 are capacitors the designation (M) meaning mylar, of which is well known to those skilled in the art. Item 44 comprises two inductor coils. Item 45 comprises two D.C. jacks rated for use with a 12 volt D.C supply. Item 46 comprises diodes. Item 47 comprises a zener diode. Item 48 is a Light Emitting Diode of any color. Item 49 is a dual pack operational amplifier for use in the commercial temperature range, any suitable equivalent may also be used. Item 50 through Item 79 are resistors, with standard commercial tolerance. Item 80 comprises two speakers suitable for use with music listening applications and preferably with high efficiency drivers that are capable of handling the power supplied by the power amplifier used to supply program power the speakers. Item 81 through Item 84 are switches rated for low power D.C. applications. Item 85 is a power amplifier supplied by a 12 volt supply suitable to power the speakers of Item 80. Item 86 through Item 89 are transistors. Item 90 and Item 91 comprise variable resistors of standard commercial tolerance. Item 92 is a crystal oscillator, suitable equivalents are well known to those skilled in the art.

While only a few preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all ranges which come within the meaning and range of equivalency of the claims are intended to be embraced herein.

What is claimed is:

1. A wireless speaker system for use in the 900 MHz frequency range, said system comprising:

a frequency modulation stereo transmitter receiving a stereo audio signal and transmitting a frequency modulation signal in the 900 MHz frequency range that is modulated by said stereo audio signal;

a frequency modulation stereo receiver capable of receiving said frequency modulation signal, said frequency modulation stereo receiver including an radio frequency mixer, a variable-frequency oscillator connected to said radio frequency mixer, a discriminator that detects said stereo audio signal and that produces a feedback signal, and a single phase-locked loop circuit that is controlled by said feedback signal to select and maintain a desired frequency of said variable-frequency oscillator; and an audio amplifier connected to said frequency modulation stereo receiver to receive and amplify the detected stereo audio signal to apply an amplified stereo audio signal to a pair of speakers.

2. The wireless speaker system of claim 1 wherein said frequency modulation stereo receiver comprises in addition an intermediate frequency mixer and an intermediate frequency variable-frequency oscillator connected to the intermediate frequency mixer and said discriminator to control a frequency of a signal applied to the intermediate frequency mixer in response to said feedback signal.

3. A single control circuit for a frequency modulation superheterodyne receiver that includes a radio frequency mixer, an intermediate frequency mixer, and a discriminator, said single control circuit effecting variable down conversion, said control circuit comprising:

a phase-locked-loop circuit connected to said discriminator and receiving a feedback signal from said discriminator, said phase-locked-loop circuit producing a signal that is controlled by said feedback signal from said discriminator; and a variable-frequency oscillator controlled by said phase-locked-loop circuit to produce a signal at a desired variable frequency that is taken to said radio frequency mixer.

4. The single control circuit of claim 3 comprising in addition an intermediate frequency voltage-controlled oscillator coupled to said intermediate frequency mixer and to said discriminator, said intermediate frequency voltage-controlled oscillator operating at a desired frequency in response to said feedback signal from said discriminator.

* * * * *